US009181813B2

(12) United States Patent
Schilp

(10) Patent No.: US 9,181,813 B2
(45) Date of Patent: Nov. 10, 2015

(54) AIR REGULATION FOR FILM COOLING AND EMISSION CONTROL OF COMBUSTION GAS STRUCTURE

(75) Inventor: Reinhard Schilp, Orlando, FL (US)

(73) Assignee: Siemens Aktiengesellschaft, München (DE)

( * ) Notice: Subject to any disclaimer, the term of this patent is extended or adjusted under 35 U.S.C. 154(b) by 688 days.

(21) Appl. No.: 13/541,841

(22) Filed: Jul. 5, 2012

(65) Prior Publication Data

US 2014/0338304 A1 Nov. 20, 2014

(51) Int. Cl.

| | |
|---|---|
| ***F23R 3/00*** | (2006.01) |
| ***F01D 9/02*** | (2006.01) |
| ***F23R 3/04*** | (2006.01) |
| ***F23R 3/02*** | (2006.01) |
| ***F23R 3/08*** | (2006.01) |
| ***F23R 3/16*** | (2006.01) |

(52) U.S. Cl.

CPC ..... *F01D 9/023* (2013.01); *F23R 3/002* (2013.01); *F23R 3/02* (2013.01); *F23R 3/04* (2013.01); *F23R 3/08* (2013.01); *F23R 3/16* (2013.01); *F23R 3/007* (2013.01)

(58) Field of Classification Search

CPC ..... F23R 3/02; F23R 3/04; F23R 3/06; F23R 3/08; F23R 3/16; F23R 3/26; F23R 3/002; F23R 3/007; F01D 9/023

See application file for complete search history.

(56) References Cited

U.S. PATENT DOCUMENTS

| | | | | |
|---|---|---|---|---|
| 2,390,959 | A | | 12/1945 | Pfenninger |
| 2,684,573 | A | | 7/1954 | Marskell et al. |
| 2,861,419 | A | | 11/1958 | Hausmann |
| 3,057,159 | A | | 10/1962 | Miller |
| 3,577,878 | A | | 5/1971 | Burnley |
| 3,765,171 | A | | 10/1973 | Hagen et al. |
| 3,859,787 | A | | 1/1975 | Anderson et al. |
| 3,930,368 | A | | 1/1976 | Anderson et al. |
| 3,958,413 | A | | 5/1976 | Cornelius et al. |
| 4,050,238 | A | * | 9/1977 | Holzapfel ..... 60/39.23 |
| 4,050,240 | A | | 9/1977 | Vaught |
| 4,944,149 | A | | 7/1990 | Kuwata |
| 5,069,029 | A | | 12/1991 | Kuroda et al. |
| 5,537,864 | A | * | 7/1996 | Sood ..... 73/112.01 |
| 5,548,951 | A | | 8/1996 | Mumford et al. |
| 5,557,920 | A | | 9/1996 | Kain |
| 5,575,616 | A | | 11/1996 | Hagle et al. |
| 5,775,098 | A | | 7/1998 | Philippona |
| 5,836,164 | A | | 11/1998 | Tsukahara et al. |
| 5,924,276 | A | | 7/1999 | Mawill |
| 6,237,323 | B1 | | 5/2001 | Ojiro et al. |
| 6,418,709 | B1 | | 7/2002 | Narcus et al. |
| 6,427,448 | B1 | | 8/2002 | Reichert |

(Continued)

*Primary Examiner* — Craig Kim

(57) ABSTRACT

A gas turbine engine compressed air flow control arrangement, including: a combustion gas structure having an acceleration geometry (20) configured to receive combustion gas (18) from a can combustor and accelerate the combustion gas (18) to a speed appropriate for delivery onto a first row of turbine blades, the combustion gas structure defining a straight combustion flow path; a film cooling hole (58) disposed through the combustion gas structure at a location within or downstream of the acceleration geometry (20); a sleeve (64) surrounding at least a portion of the combustion gas structure comprising the film cooling hole and defining a volume (62) between the combustion gas structure and the sleeve (64); and an adjustable flow control system configured to adjust a flow volume between the plenum (44) and the volume (62).

17 Claims, 3 Drawing Sheets

(56) References Cited

U.S. PATENT DOCUMENTS

| | | | | |
|---|---|---|---|---|
| 6,430,932 | B1 | 8/2002 | Martling et al. | |
| 6,564,557 | B1 | 5/2003 | Dailey | |
| 6,640,550 | B2 | 11/2003 | Hoffmann et al. | |
| 6,749,395 | B1 | 6/2004 | Reichert et al. | |
| 6,951,193 | B1 | 10/2005 | Draper | |
| 7,096,675 | B2 | 8/2006 | Jonsson et al. | |
| 7,237,386 | B2 | 7/2007 | Hoffmann et al. | |
| 7,631,504 | B2 | 12/2009 | Belsom | |
| 7,721,547 | B2 | 5/2010 | Bancalari et al. | |
| 7,798,767 | B2 | 9/2010 | Kondo et al. | |
| 8,438,856 | B2 * | 5/2013 | Chila et al. | 60/752 |
| 2005/0022531 | A1 * | 2/2005 | Burd | 60/752 |
| 2006/0053798 | A1 * | 3/2006 | Hadder | 60/772 |
| 2010/0037620 | A1 * | 2/2010 | Chila | 60/752 |
| 2010/0071382 | A1 * | 3/2010 | Liang | 60/806 |
| 2010/0077719 | A1 * | 4/2010 | Wilson et al. | 60/39.37 |
| 2010/0242487 | A1 * | 9/2010 | Davis et al. | 60/772 |
| 2011/0214428 | A1 * | 9/2011 | Shershnyov et al. | 60/754 |
| 2012/0204727 | A1 * | 8/2012 | Nordlund | 96/221 |

* cited by examiner

AIR REGULATION FOR FILM COOLING AND EMISSION CONTROL OF COMBUSTION GAS STRUCTURE

FIELD OF THE INVENTION

The invention relates to an apparatus for controlling a flow of compressed air not participating in the combustion process such that, in order to reduce emissions, the flow may provide more compressed air than minimally required for film cooling.

BACKGROUND OF THE INVENTION

Conventional gas turbine engines often include film cooling and emissions control bypass air. As higher gas turbine engine operating efficiencies are achieved, operating temperatures of the combustion gas approach and may even exceed an acceptable operating temperature for a substrate that forms the structures. In such cases film cooling of surfaces of the structure adjacent the combustion gas ("hot surface") may be implemented. Often a plurality of holes through the structure permit a portion of the compressed air from a plenum surrounding the combustors to bypass the combustor and flow directly to an interior region of the structure. Once in the interior region all of the compressed air flows unite to form a film between the combustion gas and the hot surface that protects the hot surface from the combustion gas.

Combustion with low NOx and CO emissions levels requires a combustion zone characterized by a uniform flame at a certain temperature. Emissions control bypass air provides a means for optimizing the flame. A relatively hot flame or hotter regions within the flame may produce NOX gas, and a relatively cool flame or relatively cooler regions within the flame may produce CO gas. The flame characteristics may be tuned by adjusting the fuel/air ratio, and this may be controlled by controlling the amount of air that reaches the combustor. Redirecting some of the compressed air from the plenum directly into the structure will adjust the fuel/air ratio because this redirected air simply does not reach the combustor, and therefore is not counted in the fuel/air ratio. For example, when operating at base load, only a small percentage of the plenum air may be redirected from the combustor to ensure there is sufficient air reaching the combustor. Redirecting too much air would decrease the amount of air flowing to the combustor, which would in turn yield a fuel rich (relatively hot) combustion flame that may produce excess NOx emissions. When operating at part load there may be an abundance of air through the combustor, which would yield a fuel lean mixture and therefore a relatively cool flame and associated excess CO emissions. A greater percentage of the plenum air may therefore be redirected when operating at part load to reduce the excess air at the combustor and therefore reduces CO emissions. An example of such a system is disclosed in U.S. Pat. No. 6,237,323 to Ojiro et al.

Conventional gas turbines produce combustion gas traveling at about mach 0.2 to 0.3 within the structure. As a result of the relatively fast moving combustion gas, relatively slow compressed air in the plenum exhibits a higher static pressure than does the fast moving combustion gas within the structure. This pressure difference often drives compressed air from the plenum and through the film cooling apertures. Emerging technology for can annular gas turbine engines include structures that direct combustion gas from combustion to a first row of turbine blades without a need for a first row of vanes to properly orient and accelerate the combustion gas. Structures include the combustor cans themselves together with an assembly that directs combustion gas from the combustor to the first row of turbine blades along a straight flow path at a proper speed and orientation without a first row of vanes. The assembly includes a plurality of flow directing structures, one for each combustor. One such assembly is disclosed in U.S. Pat. No. 7,721,547 to Bancalari et al. issued May 25, 2010, incorporated in its entirety herein by reference.

In both conventional combustors and emerging technology combustors the static pressure exhibited by compressed air in the plenum is approximately the same, and is greater than a static pressure exhibited by the combustion gas 18. Further, for any given set of operating parameters, the pressure difference is constant. Within prior art transition ducts combustion gas typically does not exceed approximately mach 0.2 or 0.3, and therefore exhibits a lower static pressure than the compressed air in the plenum. This pressure difference is sufficient to drive the film cooling circuit. However, unlike prior art transition ducts, in the emerging combustor technology the acceleration geometry 20 accelerates the combustion gas to, for example, mach 0.8. This substantial increase in speed within the flow directing structure 12 yields an associated substantial decrease in static pressure within the combustion gas 18. This in turn provides a much greater pressure difference between the compressed air in the plenum and the combustion gas 18 than in prior art combustion systems. This greater pressure difference is capable of providing much more air to the film circuit than the film cooling circuit needs. Under certain conditions the pressure difference may be so great that a momentum of the flow of cooling air through the film cooling holes is enough to permit the flow to separate from the hot surface. Separating from the hot surface interferes with the formation of the film, and therefore the effectiveness of the film cooling. Efficient cooling schemes are still being developed in conjunction with the emergence of the technology.

BRIEF DESCRIPTION OF THE DRAWINGS

The invention is explained in the following description in view of the drawings that show.

DETAILED DESCRIPTION OF THE INVENTION

The inventor of the present system has devised a system that utilizes unique characteristics present in emerging can annular combustor technology to combine the structures that provide film cooling air and the emissions bypass air. In particular, the system disclosed herein provides for a variable pressure drop from the plenum to the combustions gas for any given set of gas turbine engine operating parameters. In this way a flow volume through the film cooling holes may be controlled independent of the operating parameters of the gas turbine engine. Consequently, the separate film cooling and bypass air circuits of the prior art can be combined into a single circuit that is controlled remotely with a flow regulation system. Contrary to the prior art, the system disclosed herein provides adequate cooling of the structure even if the pressure difference imparts momentum to the film cooling flow sufficient to cause it to separate from the hot surface and therefore reduce the effectiveness of the film. The film cooling is still effective in this case because a sufficient volume of film cooling air is provided to overcome and inefficiency caused by the decreased film.

Figure 1:
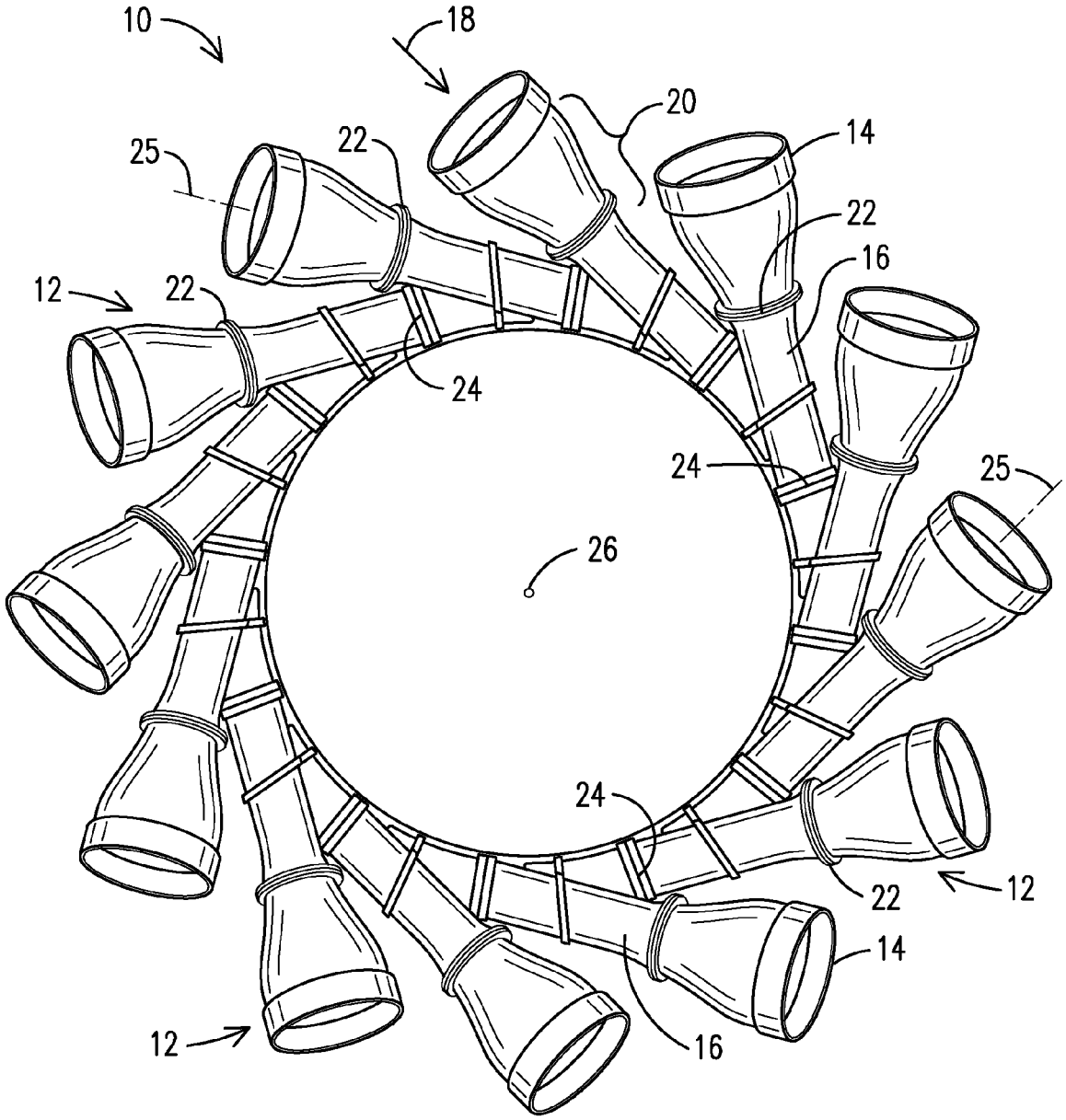
FIG. 1 PRIOR ART
FIG. 1 is a schematic representation of a prior art assembly of flow directing structures.

As shown in FIG. 1, the emerging combustor technology assembly 10 includes a plurality of flow directing structures 12. Each flow directing structure 12 may include a cone 14 and an associated integrated end piece 16 ("IEP"). Each cone 14 receives combustion gas 18 from a respective combustor (not shown), and begins accelerating the combustion gas 18 to a speed appropriate for delivery onto the first row of turbine blades (not shown). The acceleration of the combustion gas 18 is accomplished by an acceleration geometry 20 which, in this exemplary embodiment, is cone shaped. The cone 14 may abut the IEP 16 at a cone/IEP joint 22. Adjacent IEP's abut each other at IEP joints 24. The IEP's form an annular chamber immediately adjacent the first row of turbine blades (not shown). Combustion gas 18 enters a cone 14 and travels along a straight flow path within the cone 14 as the acceleration geometry 20 accelerates the combustion gas 18 to, in an exemplary embodiment, approximately mach 0.8, which is appropriate for direct delivery onto the first row of turbine blades. Upon entering the IEP 16 the combustion may continue to accelerate to the final speed and may morph from a circular cross section to a non circular cross section. Within the IEP 16 the combustion gas enters an annular chamber formed by the plurality of IEP's and may begin to rotate about a gas turbine longitudinal axis 25 in a helical manner for a short time prior to reaching the first row of turbine blades. Other embodiments may vary the specific shape of the flow directing structure 12 and the acceleration geometry 20, and these various configurations are considered within the scope of the disclosure since all configurations will have the acceleration geometry 20 as required herein.

Figure 2:
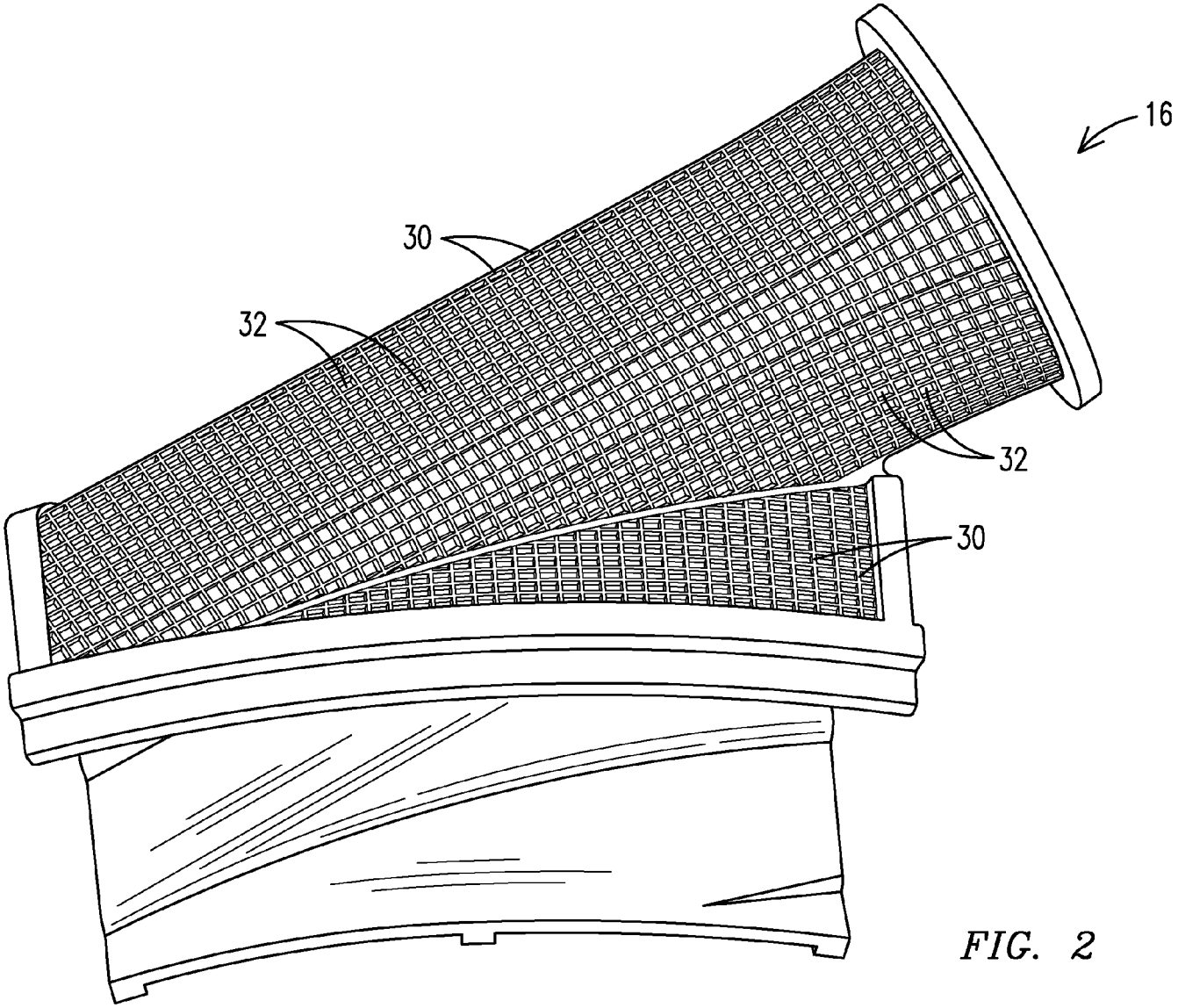
FIG. 2 is a schematic representation of an integrated exit piece (IEP).

The greater pressure difference of the emerging combustor technology may be so great that mechanical forces generated on the flow directing structure 12 may exceed the structural strength of the flow directing structures 12. As can be seen in FIG. 2, in an exemplary embodiment one technique used to reinforce the components of the flow directing structure is to provide a grid of raised ribs 30 effective to create pockets 32 on the cool (outer) surface. This design structurally reinforces the components so they can withstand the greater pressure difference. Other techniques may be employed and are considered to be within the scope of the disclosure. These pockets may be present on the combustor, the cone 14, the IEP 16, or anywhere deemed necessary.

Figure 3:
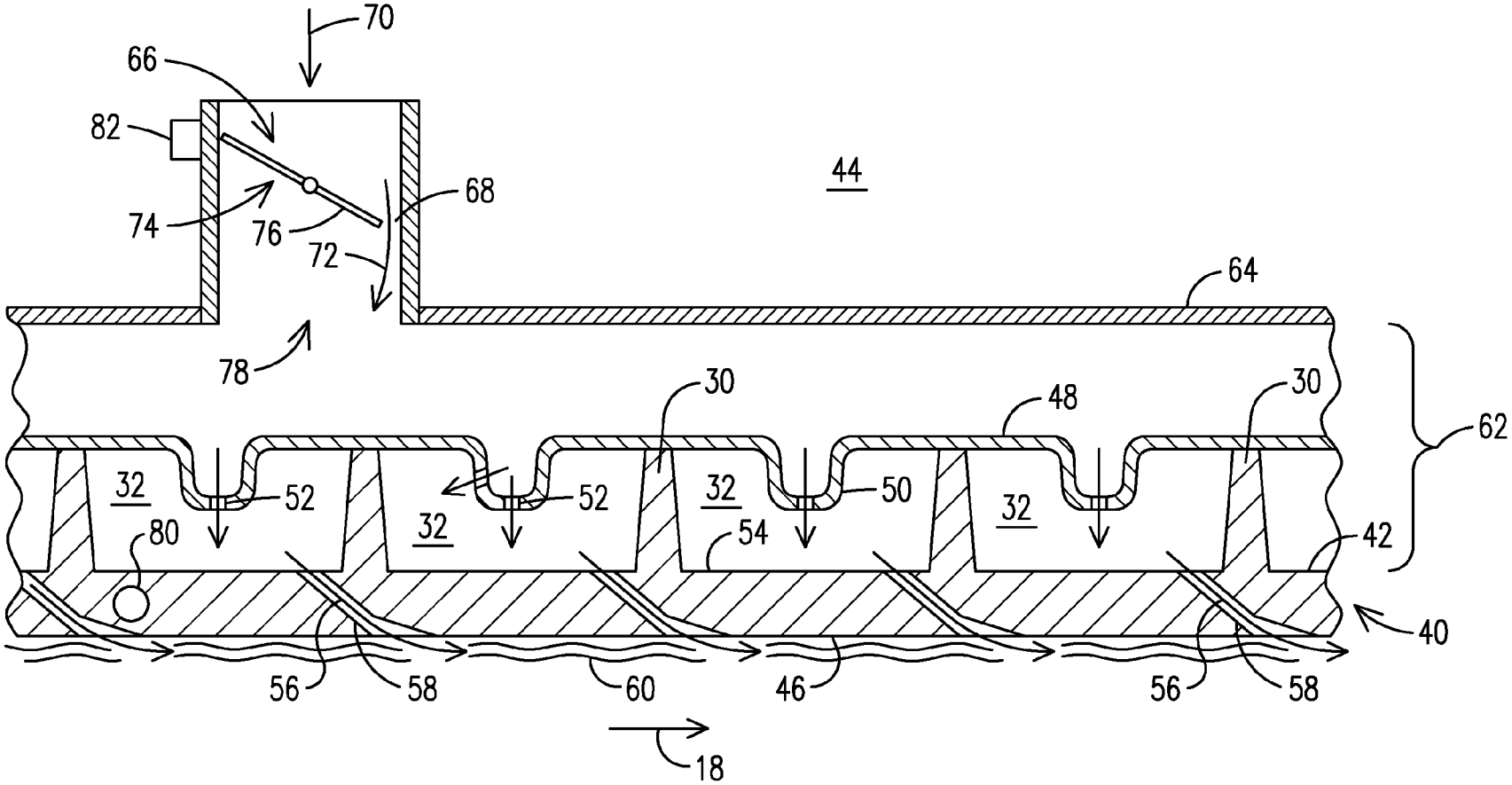
FIG. 3 is a cross section of the flow control arrangement disclosed herein.

In exemplary embodiments with raised ribs 30 forming pockets 32 impingement cooling may be utilized to effectively cool the relatively cool outer surfaces that form the pockets 32. FIG. 3 shows a wall 40 of a structure that directs combustion gas 18 and therefore to be cooled, where the wall 40 has a (relatively) cool surface 42 proximate a plenum 44 and a (relatively) hot surface 46 adjacent combustion gas 18. Optional impingement cooling may be provided by an impingement plate 48 with optional dimples 50. Impingement holes 52 are formed in the impingement plate 48 such that a stream of compressed air is directed toward a bottom surface 54 of the pocket 32. In exemplary embodiments with optional dimples 50 the impingement hole 52 may be formed in the dimple 50 as close as possible to the bottom surface 54. The pockets 32 are shown as isolated from each other with the optional impingement plate 48, but alternately may be in fluid communication with each other, or isolated from some pockets but not others etc. Film cooling will be provided by a plurality of film cooling flows 56 of compressed air originating in the plenum 44 and traversing the wall 40 through film cooling holes 58 to form a film 60. In some instances the film covers the entire hot surface and thereby protects the structure.

As with conventional film cooling, the pressure difference between the static pressure in the plenum 44 and the static pressure within the combustion gas 18 drives the film cooling flows 56 through the film cooling holes 58. However, unlike the conventional film cooling, the greater pressure difference enables much greater flow volumes/rates within film cooling flows 56 than is minimally necessary to accomplish film cooling. This is possible when the film cooling holes 58 are disposed within or downstream of the acceleration geometry 20 such that the outlets of the film cooling holes 58 are adjacent combustion gas 18 traveling at speed greater than mach 0.2 or 0.3.

The present inventor has recognized that an ability to control the flow rate of the film cooling flows 56 would enable operation effective to always provide sufficient flow volume to provide minimum film cooling, and also enable additional flow volume when emissions controls indicate a need for greater bypass air. Providing a flow volume greater than required to accomplish film cooling does not harm the structure because it simply cools the wall 40 more than is minimally required. However, providing greater flow rates than required for film cooling may, in turn, increase service life of the part.

In order to control flow rates for film cooling flows 56 of cooling air, the inventor has generated a flow control arrangement that creates a volume 62 that encloses the cool surface 42, and thereby separates the cool surface 42 from the plenum 44. The flow control arrangement provides a way to variably and/or remotely control an amount of compressed air entering that volume 62 for any given set of gas turbine engine operating parameters. By controlling the amount of compressed air being redirected from the plenum 44 into the volume 62, adequate film cooling may be ensured, and emissions control is simultaneously improved.

In an exemplary embodiment separation of the volume 62 from the plenum may be accomplished by a sleeve 64. The sleeve 64 may enclose a combustor, a cone 14, an IEP 16, or only a portion of one or more than one of these components. The sleeve 64 may be shaped independent of a shape of the component or portion thereof that the sleeve 64 is isolating. For example, for a cone 14 with an annular cross section taken perpendicular to the axis of flow, the sleeve 64 may also have an annular cross section. However, the sleeve may have a non annular cross section if such is more desirable when considering other factors such as interference of fit, or manufacturability etc. For a sleeve 64 isolating an IEP or section thereof, where the IEP has an irregular cross section, the sleeve 64 may have an annular cross section, or may have a cross section that corresponds with the cross section of the IEP, or any other shape. The shape of the sleeve 64 is of little importance. The sleeve must be structurally sufficient and provide the isolation disclosed. Similarly, when only a portion of a component is to be isolated, the shape need only be sufficient to isolate the portion.

In an exemplary embodiment one way to variably control the amount of air to be bypassed from the plenum 44 to the volume 62 is simply via one or more remotely operable valves. Although many valves known to those in the art could be used, in an exemplary embodiment a butterfly valve 66 is illustrated. A butterfly valve is simple, inexpensive, reliable, and may be configured to control flow and optionally include a failsafe 68. The failsafe 68 may be a configuration of the valve such that the valve 66 is unable to fully block the flow of bypass air 70 from the plenum 44 into the volume 62. With such a failsafe 68, the bypass air 70 will always include at least a failsafe flow 72. Such a failsafe 68 could readily be the result of a flap 74 that is shorter on a failsafe side 76 such that there always exists the failsafe 68 in the form of a gap between the failsafe side 76 and a valve wall. Any number of other failsafes could be used. The flow control arrangement may be configured such that the volume 62 receives either some or all of its cooling air via the valve 66. When all of the cooling air entering the volume 62 enters via the valve 66, the volume may be otherwise sealed from the plenum 44. Alternately, when some of the cooling air enters the volume via paths other than the valve 66, such as intentional leakage etc, the volume may not be otherwise sealed from the plenum 44. Specifically, in an exemplary embodiment, other than the valve 66, the sleeve 64 may or may not provide a full seal between the volume 62 and the plenum 44

In another exemplary embodiment another way to variably control the amount of bypass air 70 may include more complex valves. For example, sleeve 64 may be surrounded by a second, concentric sleeve with a hole matching an opening 78 in the sleeve 64, where the second sleeve is rotable about the concentric axis with respect to the first sleeve 64. When rotated the alignment of the holes would change, and this would change an opening between the plenum 44 and the volume 62, thereby acting as a flow control for the bypass air 70. Any number of various mechanisms could be used to control the bypass air 70, and these are considered within the scope of the disclosure.

When the cool surface 42 of the compressed gas structures is subject to impingement cooling as provided by the optional impingement plate 48, utilizing the flow control arrangement may further improve the impingement cooling. Due to concerns related to debris and clogging, impingement holes 52 and film cooling holes 58 are often designed to have a minimum opening size. This minimum opening size is selected to permit most debris present in gas turbine engine compressed air to pass through without plugging the cooling holes 58. However, this diameter may be greater than would be necessary if the opening were designed solely around factors related to the impingement cooling requirements. As a result, more cooling flow than is necessary for a single impingement jet may be a result of the minimum diameter required to pass debris. Further, optimal impingement cooling of the cool surface 42 may require more than one impingement flow per pocket 32 to create a proper cooling profile, but this may not be possible because the extra impingement flow(s) may introduce more air into the pocket than is acceptable when engine operation requires minimal bypass air. Stated another way, simply adding another impingement jet to reach the proper impingement cooling profile increases the amount of film cooling for a given set of operating parameters. This increase in bypass air means that a greater part of the compressed air is always redirected from the combustor and this reduces control and efficiency.

The flow control arrangement disclosed herein affords improved impingement cooling because, by controlling the amount of bypass air 70 entering the volume 62, the compressed air in the volume 62 may exhibit a static pressure below that of the compressed air in the plenum 44, and this in turn yields a decreased pressure drop that drives the impingement jets. The variably reduced pressure difference makes it possible to increase the number of impingement jets per pocket 32 without increasing the total flow into the pocket 32 to a point beyond that needed to provide minimal impingement cooling. Thus, with the flow control arrangement disclosed herein, more impingement cooling 52 may be formed per pocket because each impingement jet will have a lower flow rate than without the flow control arrangement. This allows for a minimum flow rate into and out of the pocket 32 that is more in accord with a minimum flow rate necessary to provide adequate film cooling and an associated acceptable film cooling profile. Simply by opening the valve 66 or other bypass flow controller, the flow rates of the film cooling flows 56 increase, and this provides enough air to provide sufficient film cooling and further emissions control.

In order to control film cooling, and/or impingement cooling aspects of the flow control arrangement a sensor 80 may be included to provide information regarding a temperature of the cool surface 42, the wall 40, and the hot surface 46. Many capable sensors are known to those in the art. In an exemplary embodiment the sensor 80 may be a thermocouple associated with the wall 40 and the thermocouple may provide the necessary temperature information to a controller system 82 configured to monitor the temperature and emissions and adjust the valve 66 as necessary to control the combustion process.

The flow control arrangement disclosed herein provides a single circuit that completes both film cooling and emissions control previously requiring two separate circuits. This yields lower costs associated with manufacture, assembly, and maintenance when compared to prior art systems. It affords a greater range of control over the amount of air that bypasses the combustor, and this in turn provides for improved operating efficiency. Consequently, this arrangement represents an improvement in the art.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

The invention claimed is:

1. A gas turbine engine compressed air flow control arrangement, comprising:

a combustion gas structure comprising an acceleration geometry configured to receive combustion gas from a can combustor and accelerate the combustion gas to a speed appropriate for delivery onto a first row of turbine blades, the combustion gas structure defining a straight combustion flow path and disposed in a plenum that receives compressed air from a compressor;

a film cooling hole disposed through the combustion gas structure at a location within or downstream of the acceleration geometry;

a sleeve surrounding at least a portion of the combustion gas structure comprising the film cooling hole and defining a volume between the combustion gas structure and the sleeve; and an adjustable flow control system comprising a valve disposed in a cooling air flow path between the plenum and the volume, the valve configured to adjust a flow volume through the cooling air flow path.

2. The arrangement of claim 1, wherein the adjustable flow control system comprises a butterfly valve configured to adjust the flow volume.

3. The arrangement of claim 1, comprising an impingement structure within the volume configured to provide an impingement cooling flow onto the combustion gas structure.

4. The arrangement of claim 1, wherein any compressed air entering the volume enters through the flow control system, and the volume is otherwise sealed.

5. The arrangement of claim 1, wherein flow control system comprises a fail-safe configured to always allow a minimum flow of compressed air.

6. The arrangement of claim 1, wherein a film generated by the film cooling covers an entire circumference of a hot surface adjacent the combustion gas.

7. A gas turbine engine compressed air flow control arrangement, comprising:

a sleeve configured to separate compressed air in a plenum from a structure configured to guide combustion gas in a combustion flow path from a combustor to a first row of turbine blades, wherein the sleeve and combustion gas structure define a volume there between; and an adjustable flow regulation system configured to adjust a cooling air flow path between the plenum and the volume;

wherein the combustion gas structure is configured to receive the combustion gas from a can combustor and comprises a plurality of film cooling holes effective to provide symmetric film cooling of a hot surface of the combustion gas structure using a flow of compressed air flowing through the adjustable flow regulation system, wherein the adjustable flow regulation system comprises at least a first position wherein a flow volume of compressed air through the cooling air flow path is sufficient to cool the combustion gas structure, and at least a second position that provides a greater flow volume further effective to reduce emissions.

8. The arrangement of claim 7, further comprising an impingement structure disposed in the volume and comprising an impingement hole configured to provide impingement cooling to a cool surface of the combustion gas structure.

9. The arrangement of claim 7, further comprising a sensor configured to provide information regarding a temperature of the combustion gas structure.

10. The arrangement of claim 7, wherein the combustion gas structure comprises an acceleration geometry configured to accelerate the combustion gas to a speed appropriate for delivery onto a first row of turbine blades, and wherein the film cooling hole is disposed within or downstream of the acceleration geometry.

11. The arrangement of claim 7, wherein the flow regulation system is unable to completely prevent flow there through.

12. The arrangement of claim 7, further comprising a controller system configured to control the flow regulation system to adjust a flow of bypass compressed air, effective to control formation of NOx and/or CO.

13. The arrangement of claim 7, wherein all compressed air entering the volume enters through the flow regulation system.

14. The arrangement of claim 7, wherein the volume is otherwise sealed.

15. A gas turbine engine comprising the arrangement of claim 7.

16. A gas turbine engine compressed air flow control arrangement, comprising:

a combustion gas structure defining a combustion gas flow path, the combustion gas structure comprising an acceleration geometry configured to receive combustion gas from a can combustor and accelerate the combustion gas to a speed appropriate for delivery onto a first row of turbine blades;

a sleeve configured to separate compressed air in a plenum from the combustion gas structure, wherein the sleeve and the combustion gas structure define a volume there between;

a cooling air flow path between the plenum and the volume, the cooling air flow path comprising an adjustable flow regulation system configured to adjust the flow volume, wherein the adjustable flow regulation system comprises at least a first position wherein the cooling air flow path provides a flow volume of compressed air sufficient to cool the combustion gas structure, and at least a second position that provides a greater flow volume further effective to reduce emissions; and further comprising an impingement structure disposed in the volume and configured to provide impingement cooling to a cool surface of the combustion gas structure.

17. The arrangement of claim 16, wherein in the first position the adjustable flow regulation system provides a pressure drop in the compressed air from a first pressure in the plenum to a second pressure, wherein the cool surface is characterized by a plurality of pockets and a plurality of impingement holes for each pocket.

* * * * *